US010217594B2

(12) United States Patent
Lee et al.

(10) Patent No.: US 10,217,594 B2
(45) Date of Patent: Feb. 26, 2019

(54) BRIDGE ASSEMBLY

(71) Applicant: MANDO CORPORATION, Pyeongtaek-si, Gyeonggi-do (KR)

(72) Inventors: Gon Jae Lee, Yongin-si (KR); Moon Jung Park, Bucheon-si (KR)

(73) Assignee: MANDO CORPORATION, Pyeongtaek-si, Gyeonggi-do (KR)

( * ) Notice: Subject to any disclaimer, the term of this patent is extended or adjusted under 35 U.S.C. 154(b) by 0 days.

(21) Appl. No.: 15/186,539

(22) Filed: Jun. 20, 2016

(65) Prior Publication Data

US 2016/0379791 A1 Dec. 29, 2016

(30) Foreign Application Priority Data

Jun. 23, 2015 (KR) ..... 10-2015-0089120

(51) Int. Cl.

| | |
|---|---|
| ***H01H 85/02*** | (2006.01) |
| ***H01H 85/04*** | (2006.01) |
| ***H01H 85/20*** | (2006.01) |
| ***H01H 85/36*** | (2006.01) |
| ***H01H 85/08*** | (2006.01) |

(52) U.S. Cl.

CPC ..... *H01H 85/36* (2013.01); *H01H 85/08* (2013.01); *H01H 2085/0275* (2013.01)

(58) Field of Classification Search

CPC . H01H 85/36; H01H 85/08; H01H 2085/0275
USPC ..... 337/208, 239, 401, 404, 407
See application file for complete search history.

(56) References Cited

U.S. PATENT DOCUMENTS 2,790,049 A * 4/1957 McAlister ..... H01H 37/761 337/405
2,921,167 A * 1/1960 Dahlen ..... H01H 85/36 337/181
3,638,083 A * 1/1972 Dornfeld ..... H01G 2/14 337/297
3,913,049 A * 10/1975 Burch ..... H01H 71/16 337/112
4,047,143 A * 9/1977 Burden ..... H01H 85/36 337/239

(Continued)

FOREIGN PATENT DOCUMENTS

DE 102008053182 A1 7/2010
DE 102010038070 A1 * 2/2012 ..... H01H 37/761

(Continued)

OTHER PUBLICATIONS

Korean Office Action for corresponding Korean Patent Application No. 10-2015-0089120 dated Jul. 28, 2016.

(Continued)

*Primary Examiner* — Anatoly Vortman
(74) *Attorney, Agent, or Firm* — Hauptman Ham, LLP

(57) ABSTRACT

The present invention relates to a bridge assembly. The bridge assembly according to an exemplary embodiment of the present invention includes: a bridge configured to include a first leg fixed to an upper surface of a printed circuit board, a second leg fixed to the printed circuit board to be spaced apart from the first leg, and an elastic part connecting between the first leg and the second leg and applying an elastic force to any one of the first and second legs; and a cover configured to be positioned at an upper side of the bridge to receive the elastic part.

10 Claims, 6 Drawing Sheets

(56) References Cited

U.S. PATENT DOCUMENTS 4,486,804 A * 12/1984 Watson ..... H01H 85/048 337/239
4,661,881 A * 4/1987 Watson ..... H01H 85/048 337/239
5,276,422 A * 1/1994 Ikeda ..... H01H 77/04 337/16
5,280,262 A * 1/1994 Fischer ..... H01H 37/761 337/402
5,600,295 A * 2/1997 Kaufmann ..... H01H 37/761 337/402
5,612,662 A * 3/1997 Drekmeier ..... H01H 37/761 29/623
5,770,993 A * 6/1998 Miyazawa ..... H01C 7/13 337/142
5,793,274 A * 8/1998 Kelly ..... H01H 85/048 337/141
5,896,080 A * 4/1999 Chen ..... H01H 37/761 337/401
5,999,391 A * 12/1999 Lou ..... H02H 5/041 361/103
6,088,234 A * 7/2000 Ishikawa ..... H01H 37/761 174/260
6,741,159 B1 * 5/2004 Kuczynski ..... H01H 37/002 337/142
7,002,785 B1 * 2/2006 Bothe ..... H01H 37/76 361/103
7,023,674 B2 * 4/2006 Gross ..... H01H 37/761 337/407
7,345,570 B2 * 3/2008 Kawanishi ..... H01H 37/764 337/142
8,665,057 B2 * 3/2014 Schlenker ..... H01H 37/761 337/239
8,749,940 B2 * 6/2014 Schmidtlein ..... H01H 37/761 361/103
9,083,174 B2 * 7/2015 Meyer ..... H01H 37/767
9,472,364 B2 * 10/2016 Matthiesen ..... H01H 37/70
9,620,321 B2 * 4/2017 Storzinger ..... H01H 37/761
2015/0340181 A1 11/2015 Ho et al.

FOREIGN PATENT DOCUMENTS

JP 2014-533423 A 12/2014
KR 1020110078990 B1 7/2011
KR 2012-0073248 A 7/2012

OTHER PUBLICATIONS

German Office Action for corresponding German Patent Application No. 102016007594.5 dated Jan. 30, 2017.

* cited by examiner

BRIDGE ASSEMBLY

CROSS-REFERENCE TO RELATED APPLICATION(S)

This application claims priority to Korean Patent Application No. 10-2015-0089120, filed on Jun. 23, 2015, the disclosure of which is incorporated herein by reference in its entirety.

BACKGROUND OF THE INVENTION

Field of the Invention

Exemplary embodiments of the present invention relate to a bridge installed on a printed circuit board, and more particularly, to a bridge assembly used as a thermal fuse.

Description of the Related Art

Generally, vehicles have used a surface mount technology (SMT) to attach surface mounted components (SMCs), which may be directly mounted on a surface of a printed circuit board (PCB), to an electronic circuit.

Electronic devices are called surface-mount devices (SMDs). In the electronic industry, the surface mount technology has replaced a through hole attachment method using a component which inserts a device pin into a hole of the printed circuit board.

The surface mounted component relates to a contact bridge which has a fuse function for an electronic assembly having a circuit board and may be applied with a stress and uses an appropriate solder to fix the electronic devices to the circuit board.

For example, both legs of the fuse which is a PCB conduction plate are fixed by soldering. Here, one of the legs of the fuse is inserted into the hole formed on the printed circuit board and is then fixed by the soldering and the other thereof is stably fixed to an upper surface of the printed circuit board by a fixing method.

In this case, when the printed circuit board is in an abnormal state, for example, a soldered portion at which the fuse is fixed to the upper surface of the printed circuit board is melted at a threshold temperature or more, the circuit is changed to an off state while the legs are separated from the upper surface of the printed circuit board.

However, such a used fuse needs to be subjected to a punching work for punching the hole on the printed circuit board and a fixing work, and therefore the problem that a work load of a worker is increased and a separate hole for fixing the fuse to the printed circuit board needs to be formed may occur.

RELATED ART DOCUMENT

Patent Document

Korean Patent Laid-Open Publication No. 10-2011-0078990

SUMMARY OF THE INVENTION

An object of the present invention relates to a bridge assembly capable of constraining a fuse by a housing that covers an upper surface of a printed circuit board without forming a hole for constraining the fuse on the printed circuit board.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a bridge assembly includes: a bridge configured to include a first leg fixed to an upper surface of a printed circuit board, a second leg fixed to the printed circuit board to be spaced apart from the first leg, and an elastic part connecting between the first leg and the second leg and applying an elastic force to any one of the first and second legs; and a cover configured to be positioned at an upper side of the bridge to receive the elastic part.

The first leg and the second leg may be fixed to the upper surface of the printed circuit boar by a soldered joint.

The first leg and the second leg may be soldered to the printed circuit board using soldering materials having different melting temperatures.

The elastic part may extend while being bent several times upwardly from a rear end portion of the first leg to be integrally connected to a front end portion of the second leg.

The elastic part may include: a first bending part extending while being bent upwardly from a rear end portion of the first leg; a second bending part formed to be upwardly inclined from an upper end portion of the first bending part; a third bending part extending upwardly from an upper end portion of the second bending part; a fourth bending part formed to be downwardly inclined from the third bending part to the second leg; and a fifth bending part extending while being bent from an end portion of the fourth bending part to be connected to the front end portion of the second leg.

The cover may be maintained in a state in which it adheres or is close to an upper surface of any one of the first leg and the second leg and may be formed in a state in which it is spaced apart from an upper surface of the other of the first leg and the second leg.

The cover may include a first extending part extending while adhering or being close to the upper surface of the first leg and a second extending part spaced apart from an upper side of the second leg.

The front end portion of the first leg and a rear end portion of the second leg may each protrude to outer sides of the first extending part and the second extending part.

The front end portion of the first leg may protrude to an outer side of the first extending part and a rear end portion of the second leg may be positioned at an inner side of the second extending part.

A front end portion of the first leg and a rear end portion of the second leg may each be positioned at inner sides of the first extending part and the second extending part.

The cover may have a hexahedral shape having an opening part at an upper side of any one of the first leg and the second leg.

The cover may have a semi-spherical shape having an opening part at an upper side of any one of the first leg and the second leg.

The cover may be formed at a lower surface inside a housing covering an upper portion of the printed circuit board.

According to the exemplary embodiments of the present invention, the bridge may be constrained to the inner side of the cover even when the solder fixing any one of the first leg and the second leg is melted to prevent the bridge from being separated, such that the bridge may be stably used as the thermal fuse.

According to the exemplary embodiments of the present invention, the punching work for installing the bridge on the printed circuit board is not required, and as a result the work load of the worker may be reduced and the bridge may be easily changed and used even when the diameter of the bridge is different.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

A bridge assembly according to an exemplary embodiment of the present invention will be described with reference to the accompanying drawings.

Figure 1:
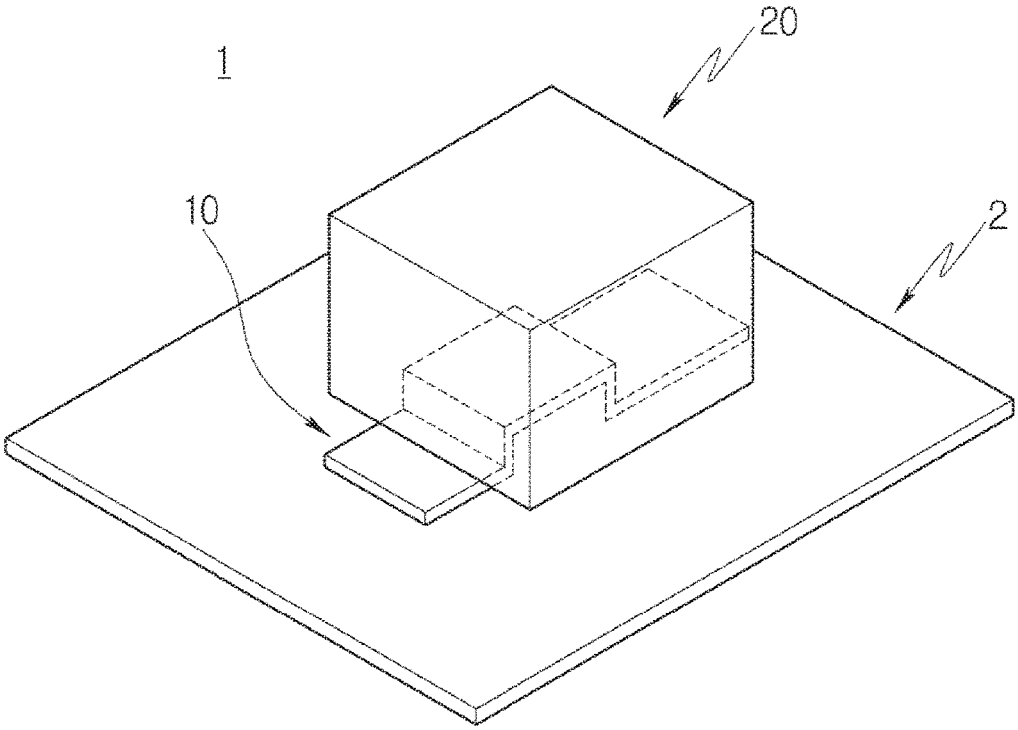
FIG. 1 is a perspective view illustrating a bridge assembly according to an exemplary embodiment of the present invention.
Figure 2:
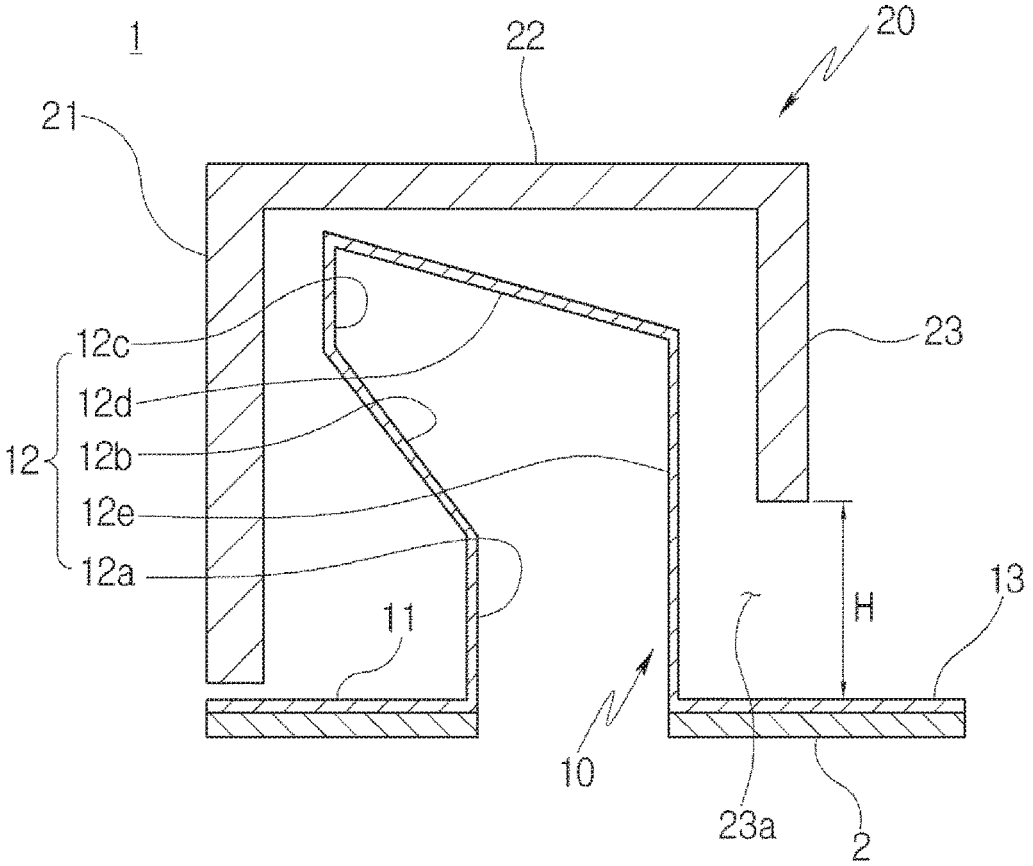
FIG. 2 is a longitudinal cross-sectional view of a state in which the bridge assembly according to the exemplary embodiment of the present invention is installed.
Figure 3:
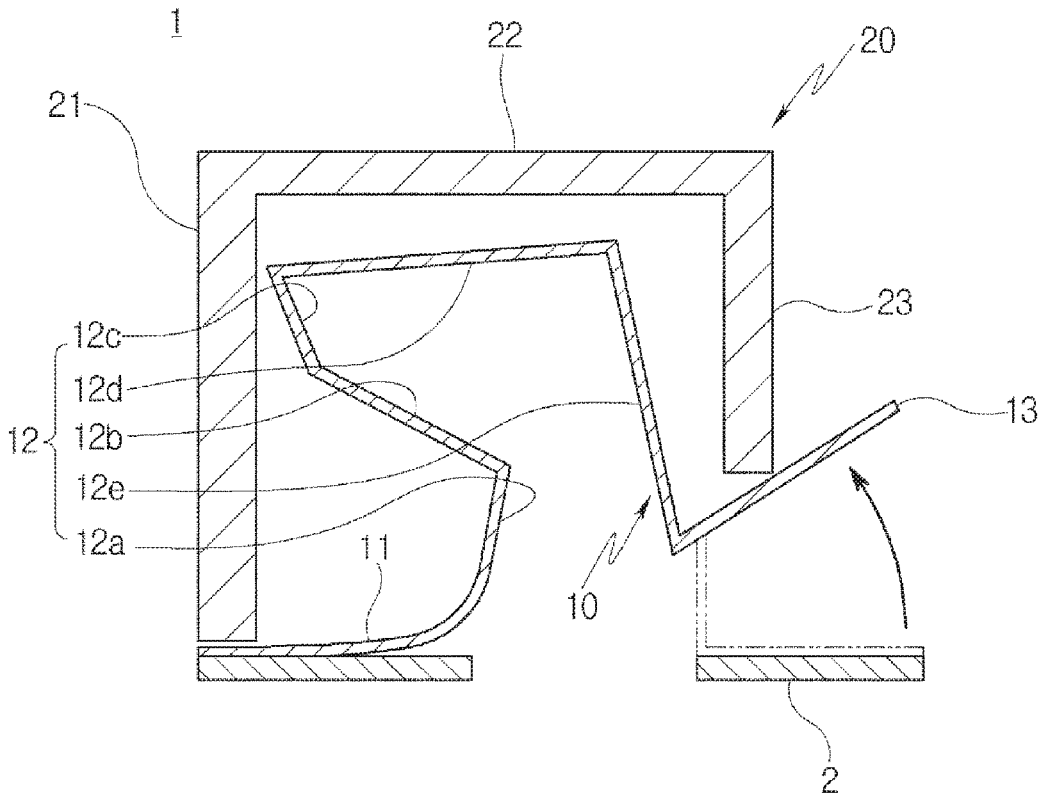
FIG. 3 is an operation state diagram of the bridge assembly according to the exemplary embodiment of the present invention.

FIG. 1 is a perspective view illustrating a bridge assembly according to an exemplary embodiment of the present invention, FIG. 2 is a longitudinal cross-sectional view of a state in which the bridge assembly according to the exemplary embodiment of the present invention is installed, and FIG. 3 is an operation state diagram of the bridge assembly according to the exemplary embodiment of the present invention.

Referring to FIGS. 1 to 3, a bridge assembly 1 according to an exemplary embodiment of the present invention may be mounted in a vehicle in which an ABS or a motor is included or may be used in a thermal protection fuse apparatus for being used as an off state when a soldered joint portion of a bridge installed on the printed circuit board is melted.

To this end, the bridge assembly 1 according to the exemplary embodiment of the present invention includes a bridge 10 fixed to an upper surface of the printed circuit board 2 and a cover 20 covering the upper surface of the bridge 10.

The bridge 10 may be made of metal or non-metal materials having an elastic restoring force but may be made of any material without being specially limited. The bridge 10 is mainly used as a thermal fuse, and therefore the bridge 10 is installed on the printed circuit board 2 to stably cut off a current applied to a device when a device (not illustrated) is in an abnormal state or a temperature of the printed circuit board 2 suddenly rises, thereby promoting a protection for the device. Further, the bridge 10 may prevent an accident occurrence due to a fire even when the device is overheated, thereby preventing a problem due to overheating.

The bridge 10 includes a first leg 11 fixed to the upper surface of the printed circuit board 2, a second leg 13 fixed to the printed circuit board 2 to be spaced apart from the first leg 11, and an elastic part 12 connecting between the first leg 11 and the second leg 13 and applying an elastic force to any one of the first leg 11 and the second leg 13.

The first leg 11 and the second leg 13 are disposed on the printed circuit board 2 to be spaced apart from each other at a predetermined interval and the first leg 11 and the second leg 13 are bonded to the printed circuit board 2 by a soldering method in the state in which they adhere to the upper surface of the printed circuit board 2. Both of the first leg 11 and the second leg 13 are made of the same soldering material, or the first leg 11 and the second leg 13 are soldered to each other using the soldering materials having different melting temperatures and a soldered portion of any one of the first leg 11 and the second leg 13 is melted at a specific temperature, such that an operation of the bridge 10 may be performed.

The elastic part 12 extends while being bent plural times upwardly from a rear end portion of the first leg 11 and thus is integrally connected to a front end portion of the second leg 13. In this case, for convenience of explanation, a direction in which the first leg is positioned is called the front and a direction in which the second leg is positioned is called the rear.

That is, the elastic part 12 may include a first bending part 12*a* extending while being bent upwardly from the rear end portion of the first leg 11, a second bending part 12*b* formed to be upwardly inclined from an upper end portion of the first bending part 12*a* to a first extending part of a cover to be described below, a third bending part 12*c* extending upwardly from an upper end portion of the second bending part 12*b*, a fourth bending part 12*d* formed to be downwardly inclined from the third bending part 12*c* to the second leg 13, and a fifth bending part 12*e* extending while being bent from an end portion of the fourth bending part 12*d* to be connected to the front end portion of the second leg 13. In this case, a shape of the elastic part 12 is formed based on the state in which the first leg 11 and the second leg 13 are fixed to the printed circuit board 2 and a length of the first bending part may be formed to be shorter than that of the second bending part.

According to the exemplary embodiment of the present invention, the elastic part has a shape bent several times but as long as the elastic part may apply the elastic force to the other leg with respect to any one of the first and second legs, the elastic part may have other shapes other than the bent shape, for example, an arch shape.

As such, the bridge 10 has the elastic force, and therefore when the state in which any one of the first leg 11 and the second leg 13 is fixed to the printed circuit board 2 is released, the fixed state to the printed circuit board 2 is stably released.

Further, according to the exemplary embodiment of the present invention, when the first leg 11 and the second leg 13 are fixed to the printed circuit board 2, elastic energy making them return to an original position is stored in the elastic part 12. Therefore, when the fixed state of any one of the first leg 11 and the second leg 13 is released from the printed circuit board 2, any one of the first and second legs 11 and 13 of which the fixed state is released is maintained in the spaced state from the printed circuit board 2.

The cover 20 is positioned at an upper side of the printed circuit board 2 in a form in which it encloses the whole or a part of the bridge 10. That is, the whole shape of the cover 20 may have a hexahedral shape of which the lower surface is open to maintain the state in which the cover 20 covers the bridge 10 fixed to the printed circuit board 2.

The cover 20 does not have a shape in which it simply covers the upper surface of the bridge 10. Meanwhile, the soldered portion at which any one of the first leg 11 and the second leg 13 of the bridge 10 is fixed is melted, and thus the whole bridge 10 is constrained to an inner side of the cover 20 without being separated from an outer side of the cover 20 even when any one of the first leg 11 and the second leg 13 is separated from the printed circuit board 2 by the elastic restoring force, such that the fixed state of the bridge 10 may be stably maintained.

The cover 20 adheres or is close to the upper surface of any one of the first leg 11 and the second leg 13 and includes an opening part to maintain the state in which it is spaced apart from the upper surface of the other of the first leg 11 and the second leg 13.

For example, the cover 20 includes an upper surface 22 positioned over the printed circuit board 2 not to interfere with the elastic part 12 of the bridge 10, a first extending part 21 extending downwardly positioned from one side of the upper surface 22 to adhere or be close to the upper surface of the first leg 11, and a second extending part 23 extending downwardly from the other side of the upper surface 22 to be toward the upper surface of the second leg 13 and positioned to be spaced apart from the second leg 13.

That is, the upper surface 22 may be positioned in parallel with the printed circuit board 2, and an opening part 23*a* having a predetermined height H is formed between the second extending part 23 and the second leg 13 and therefore a length of the first extending part 21 may be formed to be longer than that of the second extending part 23. Further, the front end portion of the first leg 11 and the rear end portion of the second leg 13 may each protrude toward outer sides of the first extending part 21 and the second extending part 23 so that they may each be constrained by the first extending part 21 and the second extending part 23.

For example, referring to FIG. 3, the first extending part 21 of the cover 20 is provided in the state in which it adheres or is close to the upper surface of the front end portion of the first leg 11 to fix the first leg 11 and a lower end portion of the second extending part 23 is positioned over the second leg 13 to be sufficiently spaced apart from the second leg 13.

Therefore, when the soldered portion of any one of the first and second legs, for example, the second leg 13 is melted and thus the second leg 13 is separated from the printed circuit board 2, the second leg 13 interferes with a lower surface of the second extending part 23 in the state in which the first leg 11 is fixed by the first extending part 21, such that the printed circuit board 2 and the second leg 13 are stably maintained in the state in which they are separated from each other, thereby preventing the bridge 10 from being separated.

As such, according to the exemplary embodiment of the present invention, the hole is punched on the printed circuit board 2 and any one of the first leg 11 and the second leg 13 is inserted into the hole so that the bridge 10 may be constrained without being fixed by the first extending part 21 and the second extending part 23 of the cover 20.

Therefore, according to the exemplary embodiment of the present invention, to install the bridge 10 on the printed circuit board 2, an operation of punching the hole on the printed circuit board 2 and inserting one end portion of the bridge 10 is unnecessary, such that the work load of the worker may be minimized and the work speed may also be improved. Further, even though the fixed state of the bridge 10 to the printed circuit board 2 is released, a portion of the bridge 10 is always constrained at the inner side of the cover, such that the problem caused by the loss of the bridge may be solved and a plurality of devices mounted on the printed circuit board 2 may be stably operated.

For example, when the bridge 10 is mounted in a hybrid vehicle driven by an ABS or a motor to be used as a thermal protection device, a malfunction of components in which the bridge 10 is mounted is prevented and even when an abnormal state caused by an overcurrent applied to the printed circuit board 2 or a sudden increase in temperature occurs, the components may be stably operated.

Figure 4:
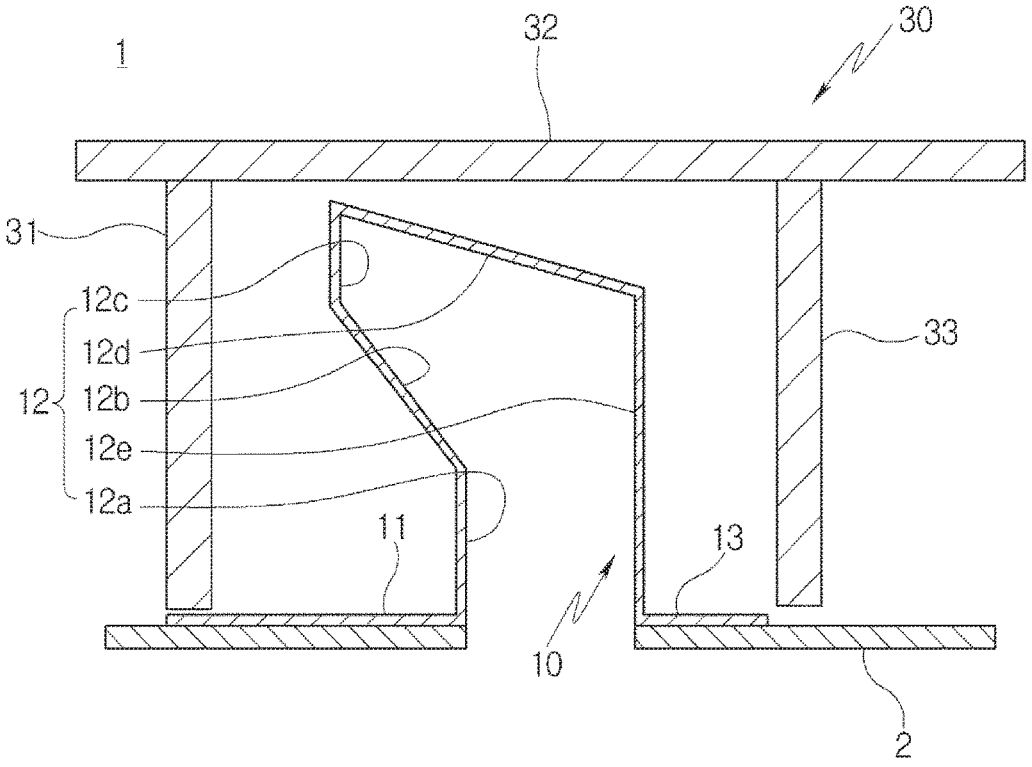
FIG. 4 is a cross-sectional view illustrating an example of a cover according to an exemplary embodiment of the present invention.

FIG. 4 is a cross-sectional view illustrating a cover according to another embodiment of the present invention.

Referring to FIG. 4, the cover according to the exemplary embodiment of the present invention is integrally formed inside the housing in which the printed circuit board and the bridge are received or is separately formed to be coupled with a lower surface inside the housing. That is, the cover may be a portion of the components of the housing in which the printed circuit board 2 and the bridge 10 are received. In this case, a first extending part 31 and a second extending part 33 extend to a lower side of an upper surface 32 of a housing 30.

The lower end portion of the first extending part 31 extends in the state in which it adheres or is close to the upper side of the first leg 11 and the second extending part 33 is positioned the outer side of the rear end portion of the second leg 13. In this case, the front end portion of the first leg 11 may protrude to the outer side of the first extending part 31 and the length of the first extending part 31 may be equal to that of the second extending part 33.

In this state, when the second leg 13 is separated from the printed circuit board 2, the first leg 11 is constrained by the first extending part 31 and the second leg 13 is not constrained by the second extending part 33 but is positioned in an inner space between the first extending part 31 and the second extending part 33 to prevent the bridge 10 from being separated from the printed circuit board 2.

Therefore, when the bridge 10 is mounted in the hybrid vehicle driven by the ABS or the motor to be used as the thermal protection device, the malfunction of components in which the bridge 10 is mounted is prevented and even when the abnormal state caused by the overcurrent applied to the printed circuit board 2 or the sudden increase in temperature occurs, the components may be stably operated.

Figure 5:
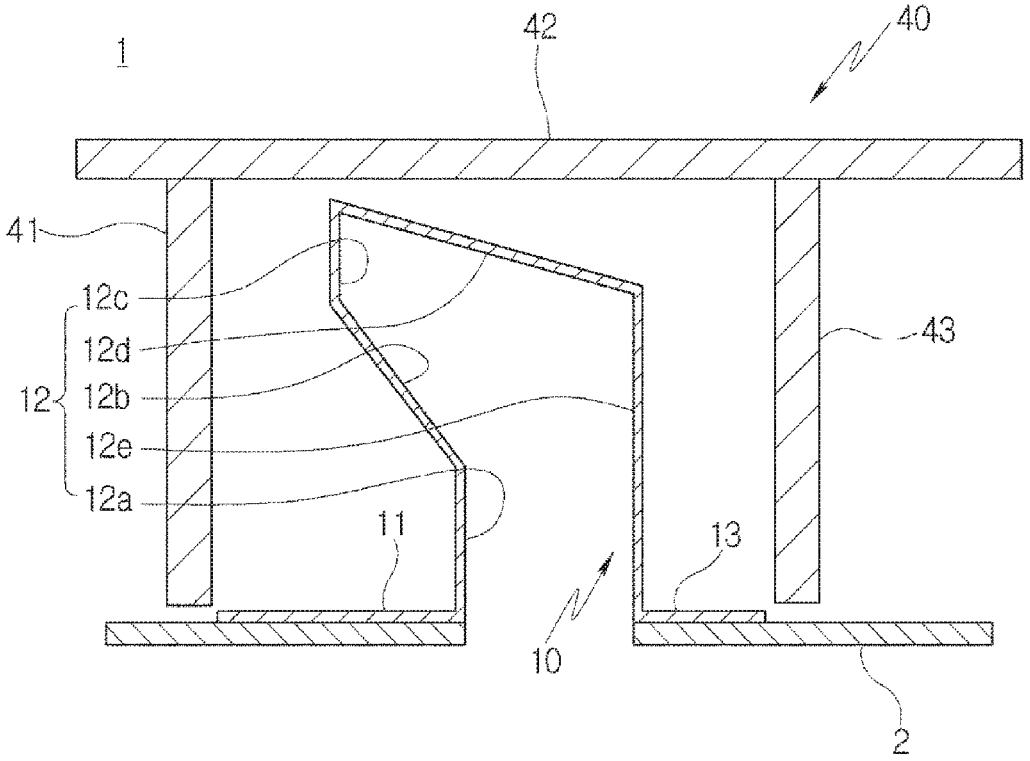
FIG. 5 is a cross-sectional view illustrating other example of the cover according to the exemplary embodiment of the present invention.

FIG. 5 is a cross-sectional view illustrating a cover according to another embodiment of the present invention.

Referring to FIG. 5, a first extending part 41 and a second extending part 43 may be integrally formed in a housing 40 in which the printed circuit board 2 and the bridge 10 are received or may be separately formed to be coupled with the housing. In this case, the first extending part 41 and the second extending part 43 extend to a lower side of an upper surface 42 of the housing 30.

In this case, the first extending part 41 and the second extending part 43 are formed to be positioned at the outer sides of the first leg 11 and the second leg 13 which are fixed to the printed circuit board 2.

That is, the front end portion of the first leg 11 is positioned at an inner side of the first extending part 41 and the rear end portion of the second leg 13 is positioned at an inner side of the second extending part 43.

Therefore, although any one of the first leg 11 and the second leg 13 or two legs are separated from the printed circuit board 2, the bridge 10 is present in an inner space between the first extending part 41 and the second extending part 43, thereby preventing the bridge from being separated.

Figure 6:
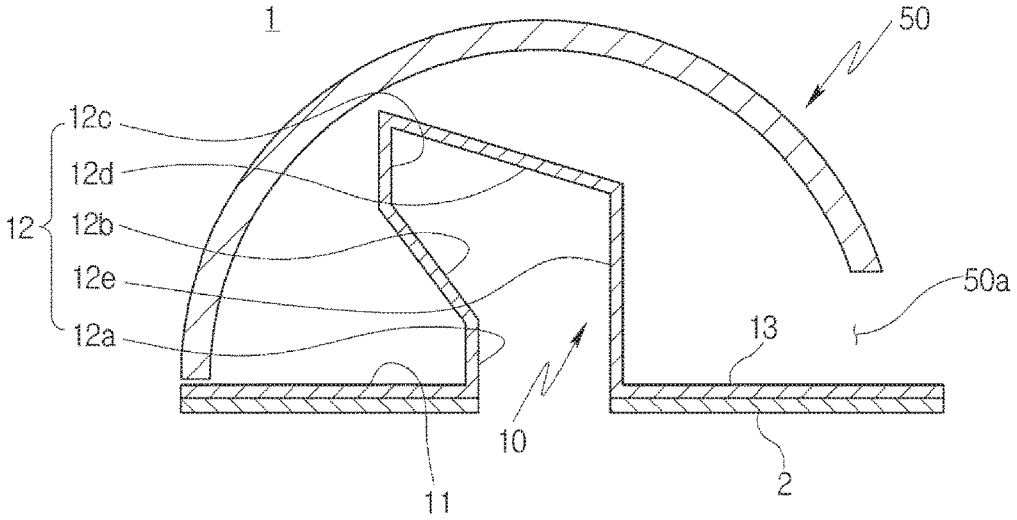
FIG. 6 is a cross-sectional view illustrating another example of the cover according to the exemplary embodiment of the present invention.

FIG. 6 is a cross-sectional view illustrating a cover according to another embodiment of the present invention.

Referring to FIG. 6, a cover 50 may have a semi-spherical shape of which the lower surface is open to maintain the state in which the cover 50 covers the bridge 10 fixed to the printed circuit board 2.

Further, the cover 50 adheres or is close to the upper surface of any one of the first leg 11 and the second leg 13 and includes an opening part 50*a* to maintain the state in which the cover 50 is spaced apart from the upper surface of the other of the first leg 11 and the second leg 13. For example, the opening part 50*a* may be positioned to correspond to the upper side of the second leg 13.

In this state, when the second leg 13 is separated from the printed circuit board 2, the first leg 11 is constrained by a lower surface of the semi-spherical cover 50 and the second leg 13 interferes with an upper end portion of the opening part 50*a* and thus the bridge 10 is positioned in the inner space of the cover 50, thereby preventing the bridge 10 from being separated from the printed circuit board 2.

Hereinabove, the embodiment of the present invention will be described, but a person having ordinary skill in the art may variously, change, delete, add, etc., components without deviating from the ideas of the present invention described in claims and it is to be construed that these changed, deleted, and added components will be included in the scope of the present invention.

What is claimed is:

1. A bridge assembly, comprising:

a bridge including a first leg fixed to a first surface of a printed circuit board, a second leg fixed to the first surface of printed circuit board to be spaced apart from the first leg, and an elastic part connecting between the first leg and the second leg and applying an elastic force to any one of the first and second legs; and a cover positioned at an upper side of the bridge to receive the elastic part, including an upper part positioned over the elastic part, a first extending part extending from a first side of the upper part to be toward a first surface of the first leg, and a second extending part extending from a second side of the upper part to be toward a first surface of the second leg, wherein a second surface of the first leg and a second surface of the second leg that are positioned opposite to the first surface of the first leg and the first surface of the second leg, respectively, are fixed to the first surface of the printed circuit board, and wherein at least one of the first and second extending parts is positioned to be spaced apart from the corresponding first surface of the first leg or the corresponding first surface of the second leg.

2. The bridge assembly of claim 1, wherein the first leg and the second leg are fixed to the first surface of printed circuit board by a soldered joint.

3. The bridge assembly of claim 1, wherein the first leg and the second leg are soldered to the printed circuit board using soldering materials having different melting temperatures.

4. The bridge assembly of claim 1, wherein the elastic part extends while being bent at least two times from a rear end portion of the first leg to be integrally connected to a front end portion of the second leg.

5. The bridge assembly of claim 1, wherein the elastic part includes a first bending part extending while being bent from a rear end portion of the first leg, a second bending part formed to be inclined from an end portion of the first bending part, a third bending part extending from an end portion of the second bending part, a fourth bending part formed to be inclined from the third bending part to the second leg, and a fifth bending part extending while being bent from an end portion of the fourth bending part to be connected to the front end portion of the second leg.

6. The bridge assembly of claim 1, wherein a front end portion of the first leg and a rear end portion of the second leg each protrude to outer sides of the first extending part and the second extending part.

7. The bridge assembly of claim 1, wherein a front end portion of the first leg protrudes to an outer side of the first extending part and a rear end portion of the second leg is positioned at an inner side of the second extending part.

8. The bridge assembly of claim 1, wherein a front end portion of the first leg and a rear end portion of the second leg are each positioned at inner sides of the first extending part and the second extending part.

9. The bridge assembly of claim 1, wherein the cover has a semi-spherical shape having an opening part at the first surface of any one of the first leg and the second leg.

10. The bridge assembly of claim 1, wherein the cover is integrally formed in a housing in which the printed circuit board is received.

* * * * *